US006106991A

United States Patent [19]

Taguchi et al.

[11] Patent Number: 6,106,991

[45] Date of Patent: Aug. 22, 2000

[54] PHOTOGRAPHIC ELEMENT

[75] Inventors: Toshiki Taguchi; Takeshi Shibata; Nobuo Seto; Hideaki Naruse; Akio Mitsui, all of Minami-ashigara, Japan

[73] Assignee: Fuji Photo Film Co., Ltd., Minami-Ashigara, Japan

[21] Appl. No.: 09/399,360

[22] Filed: Sep. 20, 1999

[30] Foreign Application Priority Data

| | | | |
|---|---|---|---|
| Sep. 21, 1998 | [JP] | Japan | 10-266593 |
| Sep. 22, 1998 | [JP] | Japan | 10-268266 |
| Sep. 22, 1998 | [JP] | Japan | 10-268281 |

[51] Int. Cl.[7] ..... G03C 8/56

[52] U.S. Cl. ..... 430/216; 430/215

[58] Field of Search ..... 430/215, 216

[56] References Cited

U.S. PATENT DOCUMENTS

| | | | |
|---|---|---|---|
| 5,254,433 | 10/1993 | Nakamura et al. | 430/216 |
| 6,010,819 | 1/2000 | Arakatsu et al. | 430/216 |

FOREIGN PATENT DOCUMENTS

| | | |
|---|---|---|
| 61-73152 | 4/1986 | Japan . |
| 61-189540 | 8/1986 | Japan . |

*Primary Examiner*—Hoa Van Le

*Attorney, Agent, or Firm*—Burns, Doane, Swecker & Mathis, LLP

[57] ABSTRACT

There is disclosed a photographic element which contains, in a binder on a base, a specified compound having a group that is capable of causing chemical reaction with a reactive group contained in the binder, to form a covalent bond. According to the photographic element, a color image excellent in light-fastness can be obtained.

15 Claims, No Drawings

PHOTOGRAPHIC ELEMENT

FIELD OF THE INVENTION

The present invention relates to photographic technique, and more particularly to a photographic element that can be used in the color diffusion transfer image formation method.

BACKGROUND OF THE INVENTION

The photographic process, in which silver halides are used, is conventionally most widely used, since it is excellent in photographic characteristics, such as sensitivity and gradation adjustment, in comparison with another photographic process, for example, electrophotography and diazo photography. The silver halide photographic process is still vigorously investigated because the highest image quality as, in particular, color hard copies can be obtained.

In recent years, from the image-formation processing method of light-sensitive materials in which silver halides are used, a system that can give an image easily and rapidly by using, for example, an instant photographic system having a built-in developing agent, or a dry-process heat-development processing using heating or the like, has been developed in place of the conventional wet process. With respect to heat-developable light-sensitive materials, "Shashin Kogaku No Kiso (Hi-ginen Shashin-hen)", published by Corona Co., p.242-, describes them, which is only directed to the black-and-white image formation method for dry silver as a representative. Various ideas about chemical reactions through which color images can be formed are reviewed in detail in Angew. Chem. Int. Ed. Engl. 1983 (22), 191-. Recently, as heat-developable color light-sensitive materials, such products as PICTROGRAPHY and PICTROSTAT (trade names) have been released from Fuji Photo Film, Co., Ltd. In the above simple and rapid processing method, a color image is formed by using a redox compound having a preformed dye attached thereto (coloring material). According to the method that uses this redox compound, an image is formed on an image-receiving sheet by the diffusion transfer process, and therefore a beautiful color image can be formed without requiring fixing of the light-sensitive material. Further, in comparison with the method in which a dye is formed by the coupling reaction between the oxidized product of a developing agent and a coupler, which method is most generally carried out in the field of photography, in the method that uses the redox compound, a color light-sensitive material advantageous in color reproduction can be designed, since a dye to give a preferable hue can be chosen in advance.

SUMMARY OF THE INVENTION

The investigation made by the inventors of the present invention on color light-sensitive materials of the diffusion transfer type as described above, has, however, revealed that the color photograph formed by using them is inferior in light-fastness to that of usual color photographs, wherein the formed dyes are dispersed in oil droplets. Particularly, this is conspicuous in cyan dyes of longest wavelengths, and improvement is desired. Various techniques have been studied to overcome this defect, but still, few have attained a level comparable to the usual color photographic light-sensitive materials in which couplers are used. Particularly, investigation on the method for improving the light-fastness of cyan dyes of the naphthol azo type has only failed to achieve a satisfactory result for the light-sensitive material system intended by us, if only conventional technique is applied to usual naphthol azo-type cyan dyes. Further, in particular, as a method for improving the light-fastness of a dye in a color light-sensitive material including those of a diffusion transfer type, techniques that use a nitrogen-containing heterocyclic compound are described in JP-A-61-73152 ("JP-A" means unexamined published Japanese patent application), JP-A-61-189540, etc., but investigation on them by the present inventors have brought only about unsatisfactory results in the light-sensitive material system under development by the present inventors.

Therefore, an object of the present invention is to provide a photographic element that can form a dye image fast to light in a system that uses a diffusion transfer-type color light-sensitive material.

Other and further objects, features, and advantages of the invention will appear more fully from the following description.

DETAILED DESCRIPTION OF THE INVENTION

The object of the present invention has been attained by the photographic elements stated under items 1 to 5 shown below:

1) A photographic element, which contains, at least in a binder on a base, at least one compound having a group that is capable of causing chemical reaction with a reactive group contained in the binder, to form a covalent bond, wherein the compound is a compound represented by the following formula (1), (2), or (3):

formula (1)

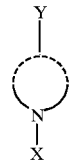

wherein the ring structure containing the N represents a nitrogen-containing nonaromatic ring having at least three ring members, X represents a hydrogen atom, an alkoxy group, an aryloxy group, an oxy radical group, a hydroxyl group, or a group capable of forming an imino group or a hydroxyimino group by hydrolysis, and Y represents a group that is capable of causing chemical reaction with a reactive group contained in the binder, to form a covalent bond; formula (2)

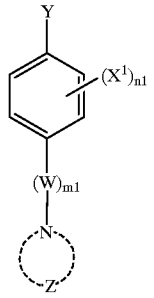

wherein $X^1$ represents a hydrogen atom or a substituent, which substituent may bond to form a ring, n1 is an integer of 1 to 4, Y represents a group that is capable of causing chemical reaction with a reactive group contained in the binder, to form a covalent bond, W represents a divalent linking group, m1 is 0 or 1, and Z represents a group of nonmetallic atoms capable of forming a 5- to 7-membered nitrogen-containing heterocyclic group; formula (3)

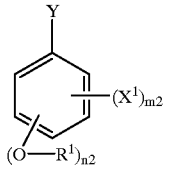

wherein $R^1$ represents a hydrogen atom, an alkyl group, an aryl group, or a group capable of forming a hydroxyl group by hydrolysis, n2 is an integer of 1 or more, $X^1$ represents a hydrogen atom or a substituent, m2 is an integer of 1 or more, with m2+n2 being 5, and Y represents a group that is capable of causing chemical reaction with a reactive group contained in the binder, to form a covalent bond;

2) The photographic element as stated in the above 1), wherein the binder contains at least one mordant polymer;

3) The photographic element as stated in the above 1) or 2), wherein the reactive group capable of causing reaction with Y in formula (1), (2), or (3) is contained in the mordant polymer;

4) The photographic element as stated in the above 1), 2), or 3), wherein the mordant polymer contains tertiary nitrogen atoms; and 5) The photographic element as stated in the above 1), 2), 3), or 4), wherein the ring structure containing the N in formula (1) is a pyrrolidine ring or a piperidine ring.

First, the compound represented by formula (1), (2), or (3) is described.

In formula (1), the ring structure containing the N represents a group of atoms that form a nitrogen-containing nonaromatic ring having at least three ring members (e.g., an aziridine ring, a pyrrolidine ring, and a piperidine ring). This nonaromatic ring may be substituted and may have an unsaturated bond(s) in the range wherein an aromatic π electron system is not formed. Among those, a pyrrolidine ring and a piperidine ring are preferable and a piperidine ring is particularly preferable. In particular, derivatives of tetramethylpyrrolidine or tetramethylpiperidine, wherein a methyl group is substituted on the carbon atom adjacent to the N atom, are preferably used.

In formula (1), X represents a hydrogen atom, an alkoxy group (e.g., methoxy, ethoxy, butoxy, and octyloxy), an aryloxy group (e.g., phenoxy and tolyloxy), an oxy radical group, a hydroxyl group, or a group that forms an imino group or a hydroxyimino group by hydrolysis. As the group that forms an imino group or a hydroxyimino group by hydrolysis, can be mentioned, for example, a group represented by —Q—R, —Q—O—R, —Q—N—R(R'), —O—Q—R, —O—Q—O—R, or —O—Q—N—R(R'), wherein Q represents a divalent linking group selected from among a carbonyl group, an imino group, an α-diketo group, a sulfonyl group, and a group —PO(R")— in which R" represents any one of an alkyl group, an aryl group, an alkylamino group, an arylamino group, an alkoxy group, and an aryloxy group; R represents any one of an alkyl group, an aryl group, and a heterocyclic group; when Q represents an imino group, R and Q may bond together to form a ring; and R' represents any one of a hydrogen atom, an alkyl group, an aryl group, and a heterocyclic group. Specific examples of such a group include, for example, an alkylcarbonyl group (e.g. acetyl, propionyl, and butyloyl), an arylcarbonyl group (e.g. benzoyl and alkylbenzoyl), an alkylcarbamoyl group (e.g. methylcarbamoyl, dimethylcarbamoyl, ethylcarbamoyl, diethylcarbamoyl, dibutylcarbamoyl, piperidinocarbamoyl, and morpholinocarbamoyl), an arylcarbamoyl group (e.g. phenylcarbamoyl, methylphenylcarbamoyl, ethylphenylcarbamoyl, and benzylphenylcarbamoyl), a carbamoyl group, an alkoxycarbonyl group (e.g. methoxycarbonyl, ethoxycarbonyl, and butoxycarbonyl), an aryloxycarbonyl group (e.g. phenoxycarbonyl), an acyloxy group (e.g. acetyloxy, propionyloxy, and butyloyloxy), an alkylcarbonyloxy group (e.g. acetoxy, and propionyloxy), an arylcarbonyloxy group (e.g. benzoyloxy, and alkylbenzoyloxy), an alkoxycarbonyloxy group (e.g. methoxycarbonyloxy, and ethoxycarbonyloxy), an aryloxycarbonyloxy group (e.g. phenoxycarbonyloxy), an alkylcarbamate group (e.g. dimethylcarbamoyloxy), an arylcarbamate group (e.g. ethylphenylcarbamoyloxy), an alkylsulfonyl group (e.g. methanesulfonyl, and ethanesulfonyl), an arylsulfonyl group (e.g. phenylsulfonyl, 4-chlorophenylsulfonyl, and p-toluenesulfonyl), an alkylsulfamoyl group (e.g. methylsulfamoyl, dimethylsulfamoyl, ethylsulfamoyl, diethylsulfamoyl, dibutylsulfamoyl, piperidinosulfamoyl, and morpholinosulfamoyl), an arylsulfamoyl group (e.g. phenylsulfamoyl, methylphenylsulfamoyl, ethylphenylsulfamoyl, and benzylphenylsulfamoyl), a sulfamoyl group, and an alkyloxalyl group (e.g. ethyloxalyl).

In formulae (2) and (3), $X^1$ represents a hydrogen atom or a substituent. Specific examples of the substituent include, for example, a halogen atom (e.g. chloro and bromo), an alkyl group (e.g. methyl, ethyl, isopropyl, n-butyl, and t-butyl), an aryl group (e.g. 3-methanesulfonylaminophenyl), an alkylcarbonamido group (e.g. acetylamino, propionylamino, and butyroylamino), an arylcarbonamido group (e.g. benzoylamino), an alkylsulfonamido group (e.g. methanesulfonylamino and ethanesulfonylamino), an arylsulfonamido group (e.g. benzenesulfonylamino and toluenesulfonylamino), an alkylthio group (e.g. methylthio, ethylthio, and butylthio), an arylthio group (e.g. 4-methanesulfonylaminophenylthio), an alkylcarbamoyl group (e.g. methylcarbamoyl, dimethylcarbamoyl, ethylcarbamoyl, diethylcarbamoyl, dibutylcarbamoyl, piperidinocarbamoyl, and morpholinocarbamoyl), an arylcarbamoyl group (e.g. phenylcarbamoyl, methylphenylcarbamoyl, ethylphenylcarbamoyl, and benzylphenylcarbamoyl), a carbamoyl group, an alkylsulfamoyl group (e.g. methylsulfamoyl, dimethylsulfamoyl, ethylsulfamoyl, diethylsulfamoyl, dibutylsulfamoyl, piperidinosulfamoyl, and morpholinosulfamoyl), an arylsulfamoyl group (e.g. phenylsulfamoyl, methylphenylsulfamoyl, ethylphenylsulfamoyl, and benzylphenylsulfamoyl), a sulfamoyl group, a cyano group, an alkylsulfonyl group (e.g. methanesulfonyl and ethanesulfonyl), an arylsulfonyl group (e.g. phenylsulfonyl, 4-chlorophenylsulfonyl, and p-toluenesulfonyl), an alkoxycarbonyl group (e.g. methoxycarbonyl, ethoxycarbonyl, and butoxycarbonyl), an aryloxycarbonyl group (e.g. phenoxycarbonyl), an alkylcarbonyl group (e.g. acetyl, propionyl, and butyloyl), an arylcarbonyl group (e.g. benzoyl and alkylbenzoyl), and a sulfo group. These substituents may bond together to form a ring. As a preferable substituent, an alkyl group, an aryl group, a sulfo group, an alkylcarbonamido group, an alkylsulfonamido group, or the like, can be mentioned. In formula (2), n1 is an integer of 1 to 4.

In formula (2), W represents a divalent linking group, and m1 is 0 or 1. As the divalent linking group, various ones can be chosen, such as an ether group, an alkylene group, an arylene group, and a carbonyl group, but preferably m1 is 0. In formula (2), Z represents a group of nonmetallic atoms capable of forming, together with the N, a 5- to 7-membered nitrogen-containing heterocyclic group. As examples of the ring, various ones, such as a pyrrolidine ring, a piperidine ring, a piperazine ring, and a morpholine ring, can be mentioned, and preferably the ring is a 6-membered ring and most preferably a nitrogen/sulfur-containing heterocycle having an S atom in the forth position counted from an N atom. Particularly, one wherein the group having the S atom is a sulfonyl group is most preferable.

In formula (3), $R^1$ represents a hydrogen atom, an alkyl group (e.g., methyl, ethyl, butyl, and octyl), an aryl group (e.g., phenyl, tolyl, and xylyl), or a group that forms a hydroxyl group by hydrolysis. As the group of $R^1$ in formula (3) that forms a hydroxyl group by hydrolysis, can be mentioned an acyl group (e.g., acetyl, trifluoroacetyl, propionyl, butyloyl, and benzoyl), an alkoxycarbonyl group (e.g., methoxycarbonyl and ethoxycarbonyl), an aryloxycarbonyl group (e.g., phenoxycarbonyl), a carbamoyl group (e.g., dimethylcarbamoyl, diethylcarbamoyl, diphenylcarbamoyl, ethylphenylcarbamoyl, and morpholinocarbamoyl), an alpha-diketo group (e.g., alpha-diketophenyl), an alkyloxalyl group (e.g., ethyloxalyl), and an alpha-diketoamino group (e.g., alpha-diketoanilino). Among these, in particular, $R^1$ preferably represents a hydrogen atom or a lower alkyl group. In formula (3), n2 is an integer of 1 or more.

Each of the groups represented by $R^1$ may further be substituted by at least one of the substituents mentioned as specific examples of the above $X^1$.

Further, in formula (3), the group $X^1$ and the group —O—$R^1$ may bond together to form a ring. In formula (3), m2 is an integer of 1 or more, and (m2+n2) equals to 5.

In formulae (1), (2), and (3), Y represents a group that is capable of causing chemical reaction with a reactive group contained in the binder, to form a covalent bond. The reaction of Y with the binder permits the compound represented by formula (1), (2) or (3) to be fixed in the photographic element of the present invention. Any organic chemical reaction capable of the formation of a covalent bond to meet that end, can be utilized. Examples thereof include nucleophilic substitution reactions represented, for example, by the $S_{N1}$ and $S_{N2}$ reactions; addition reactions represented, for example, by the Michael reaction; pericyclic reactions represented, for example, by the Diels-Alder reaction; and coupling reactions involving redox widely used in photochemistry, any of which reaction can be used.

As the binder that is the partner in the fixing reaction, a polymer compound is generally used, and for the purpose of the present invention, any of oil-soluble polymers, water-soluble polymers, and polymer latexes can be used. Amongst those, a mordant polymer that can mordant a diffusion dye released and transferred in a diffusion transfer-type color light-sensitive material by ion interaction, is preferably used. Examples of such a polymer include polymers having secondary and/or tertiary amino groups, polymers having nitrogen-containing heterocyclic moieties, and polymers containing quaternary cation groups thereof, and the molecular weight of these polymers is generally 5,000 to 200,000 and particularly preferably 10,000 to 50,000. Among them, in particular, polymers having secondary or tertiary nitrogen atoms are preferable, and polymers having tertiary nitrogen atoms are more preferable.

Specific examples of the polymer are described, for example, in the following specifications: U.S. Pat. Nos. 2,548,564, 2,484,430, 3,148,061, 3,756,814, 3,625,694, 3,859,096, 4,128,538, 3,958,995, 2,721,852, 2,798,063, 4,168,976, 3,709,690, 3,788,855, 3,642,482, 3,488,706, 3,557,066, 3,271,147, 3,271,148, 2,675,316, 2,882,156, Great Britain Patent No. 1 277 453, JP-A-54-115228, JP-A-54-145529, JP-A-54-126027, JP-A-50-71332, JP-A-53-30328, JP-A-52-155528, JP-A-53-125, and JP-A-53-1024.

When it is considered to form a covalent bond by the reaction between such a mordant polymer and the compound represented by formula (1), (2), or (3), the most preferably usable organic chemical reaction makes use of a nucleophilic reaction for Y of the compound represented by formula (1), (2) or (3), by the nucleophilic nitrogen atom contained in the mordant polymer. As the group usable for that, preferably as the Y in formulae (1), (2) and (3), can be mentioned, for example, a halogenated alkyl group, a halogenomethylenearyl group, a halogenomethylenecarbonyl group, a halogenomethylenecarbonyloxy group, a halogenomethylenecarbonamido group, a halogenomethylenesulfonyl group, a halogenomethylenesulfonamido group, an alkylsulfonyloxyalkyl group, an alkylsulfonyloxymethylenearyl group, an alkylsulfonyloxymethylenecarbonyl group, an alkylsulfonyloxymethylenecarbonyloxy group, an alkylsulfonyloxymethylenecarbonamido group, an arylsulfonyloxyalkyl group, an arylsulfonyloxymethylenearyl group, an arylsulfonyloxymethylenecarbonyl group, an arylsulfonyloxymethylenecarbonyloxy group, an arylsulfonyloxymethylenecarbonamido group, a vinylcarbonyl group, a vinylcarbonyloxy group, a vinylcarbonamido group, a vinylsulfonyl group, a vinylsulfonamido group, an epoxy group, an episulfido group, and a formyl group.

Specific examples of the compound represented by formula (1), (2) or (3) are shown below, which are not intended to limit the scope of the present invention.

TB-1

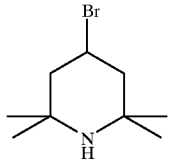

TB-2

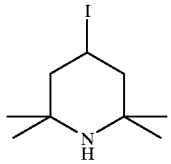

TB-3

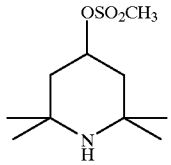

TB-4

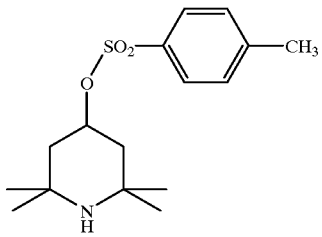

-continued
TB-5
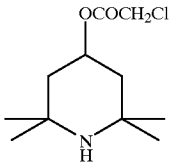
TB-6
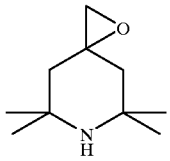
TB-7
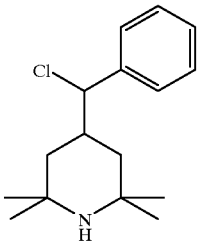
TB-8
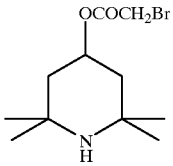
TB-9
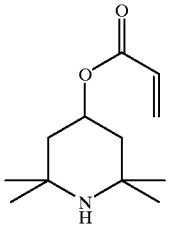
TB-10
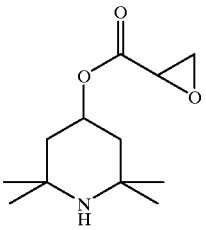
TB-11
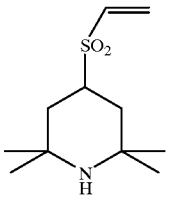
-continued
TB-12
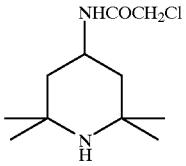
TB-13
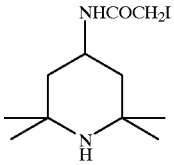
TB-14
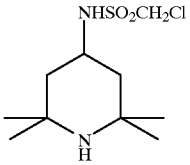
TB-15
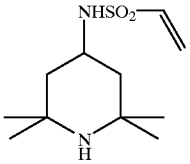
TB-16
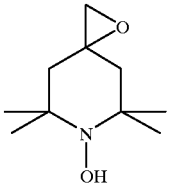
TB-17
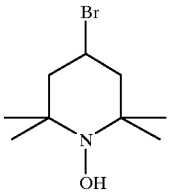
TB-18
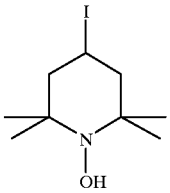
TB-19
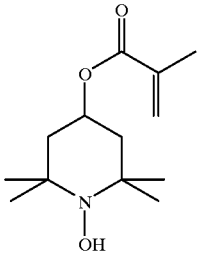

-continued
TB-20
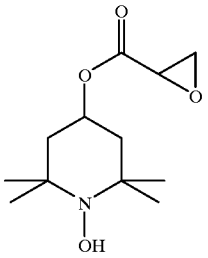
TB-21
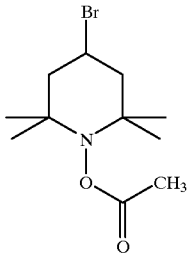
TB-22
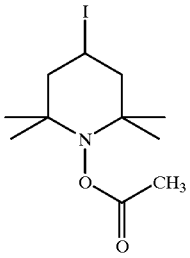
TB-23
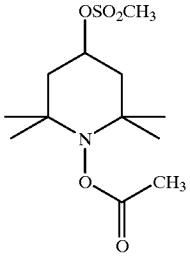
TB-24
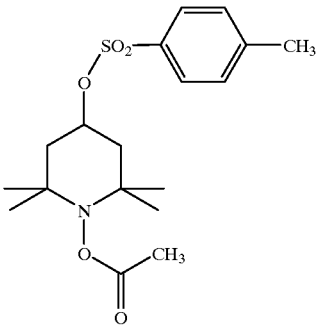
-continued
TB-25
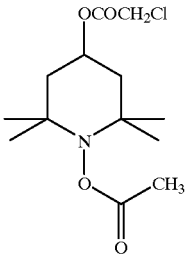
TB-26
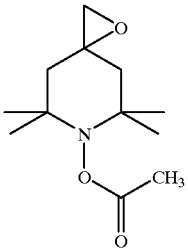
TB-27
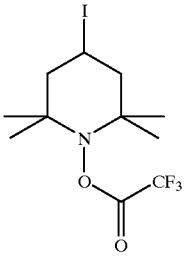
TB-28
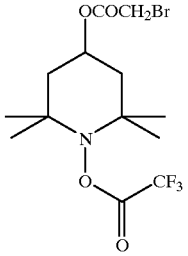
TB-29
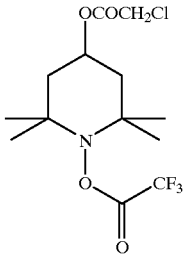

-continued
TB-30
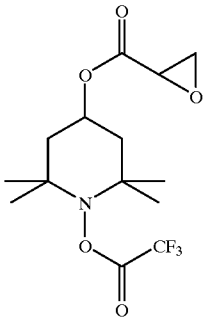
TB-31
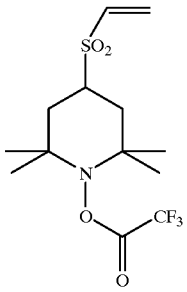
TB-32
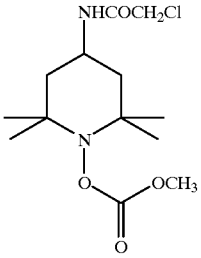
TB-33
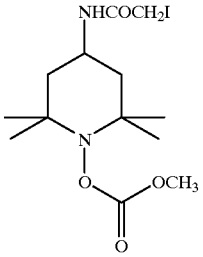
TB-34
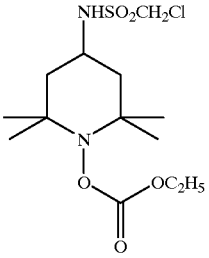
-continued
TB-35
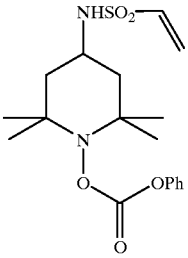
TB-36
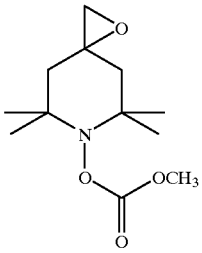
TB-37
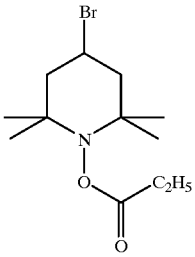
TB-38
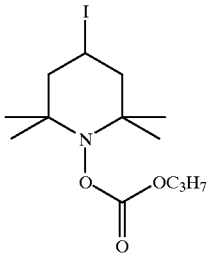
TB-39
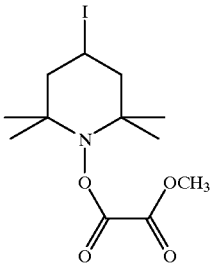

-continued
TB-40
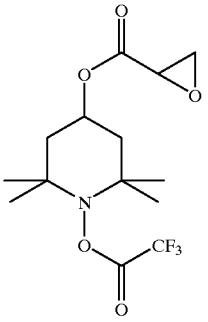
TB-41
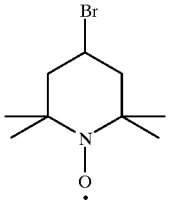
TB-42
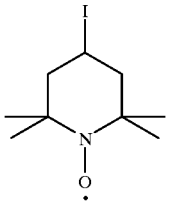
TB-43
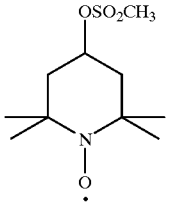
TB-44
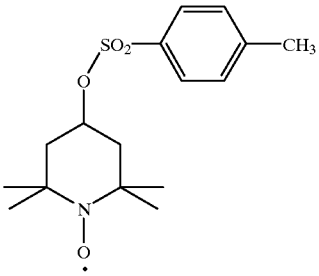
TB-45
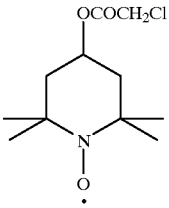
-continued
TB-46
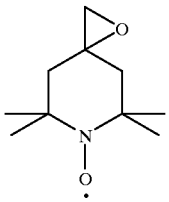
TB-47
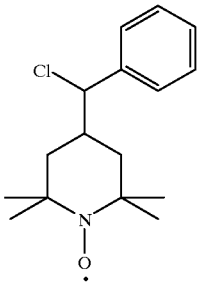
TB-48
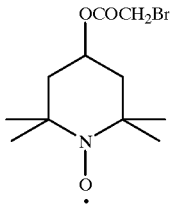
TB-49
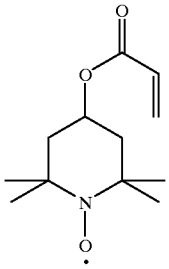
TB-50
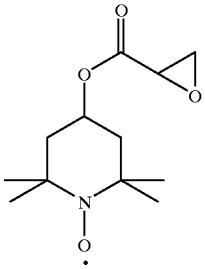
TB-51
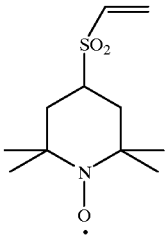

-continued
TB-52
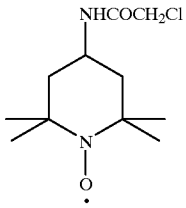
TB-53
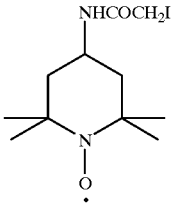
TB-54
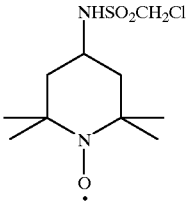
TB-55
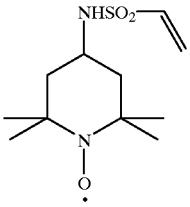
TB-56
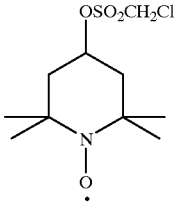
TB-57
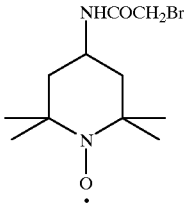
TB-58
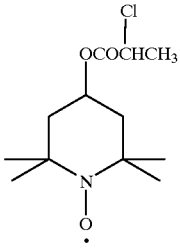
-continued
TB-59
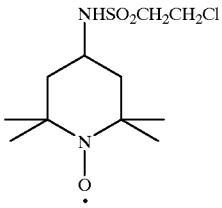
TB-60
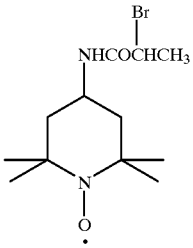
TB-61
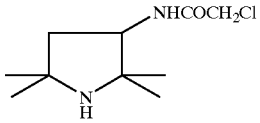
TB-62
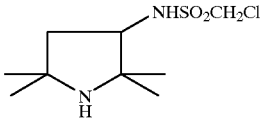
TB-63
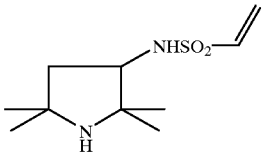
TB-64
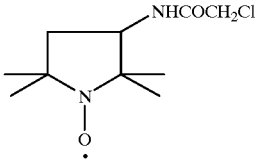
TB-65
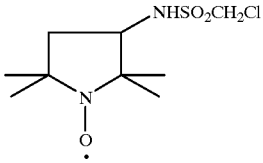
TB-66
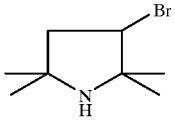
TB-67
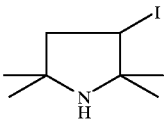

-continued
TB-68
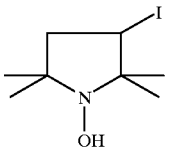
TB-69
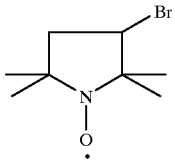
TB-70
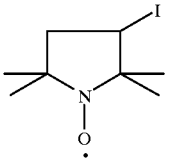
TB-71
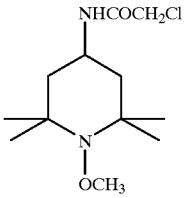
TB-72
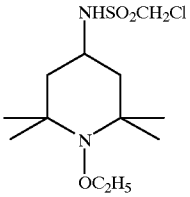
TB-73
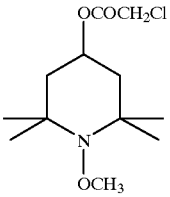
TB-74
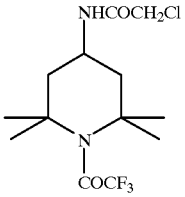
TB-75
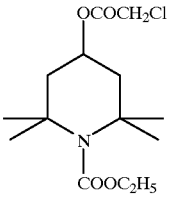
-continued
TB-76
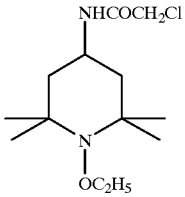
TB-77
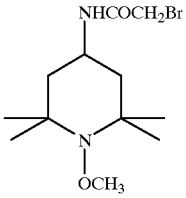
TB-78
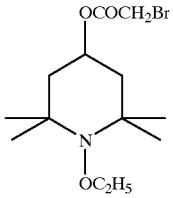
TB-79
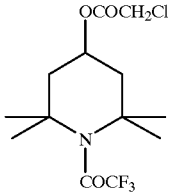
TB-80
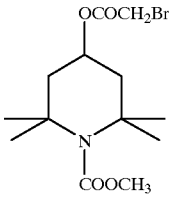
TB-101
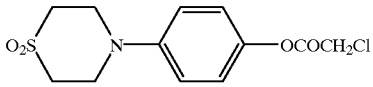
TB-102
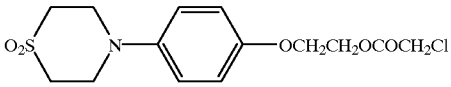
TB-103
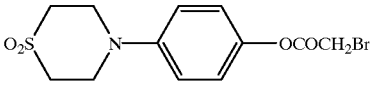
TB-104
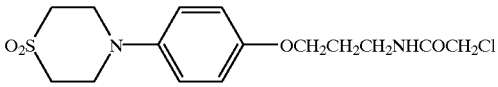

-continued
TB-105
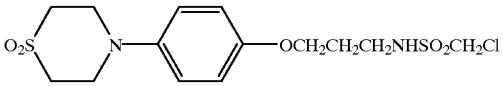
TB-106
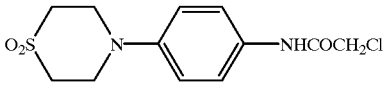
TB-107
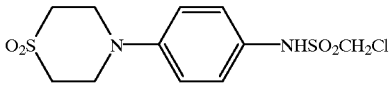
TB-108
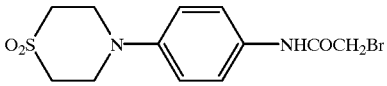
TB-109
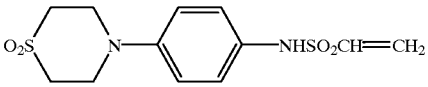
TB-110
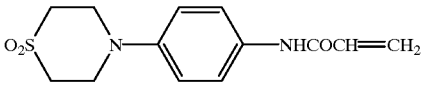
TB-111
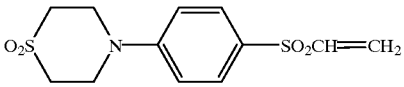
TB-112
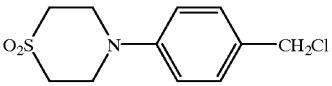
TB-113
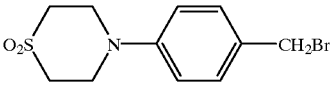
TB-114
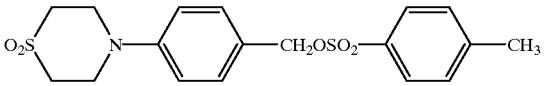
TB-115
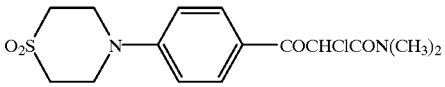
TB-116
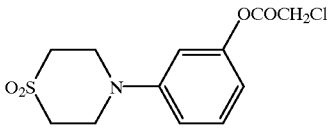
TB-117
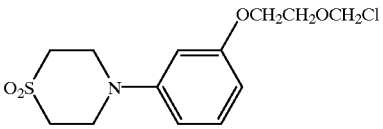
-continued
TB-118
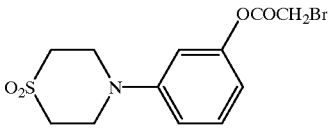
TB-119
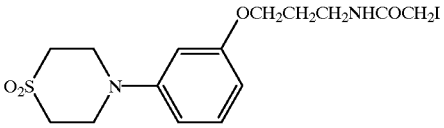
TB-120
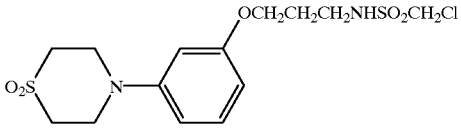
TB-121
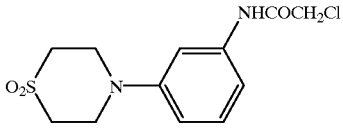
TB-122
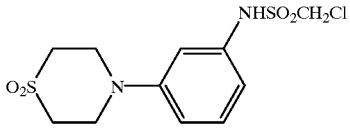
TB-123
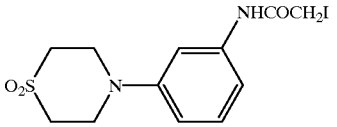
TB-124
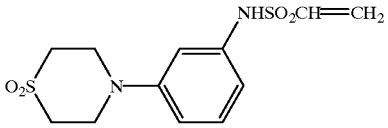
TB-125
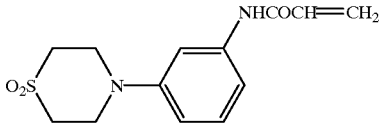
TB-126
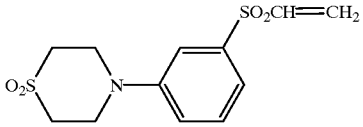
TB-127
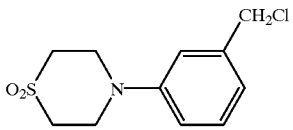

-continued
TB-128
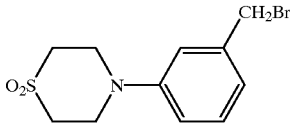
TB-129
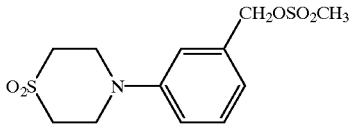
TB-130
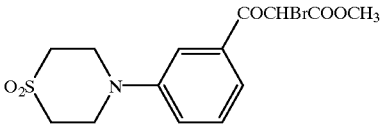
TB-131
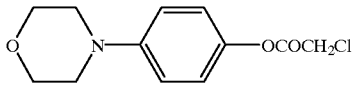
TB-132
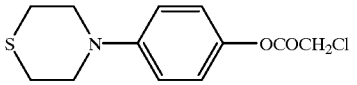
TB-133
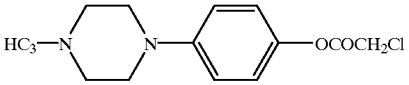
TB-134
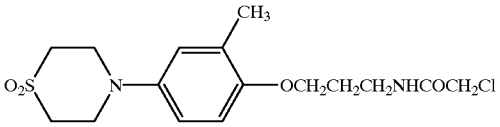
TB-135
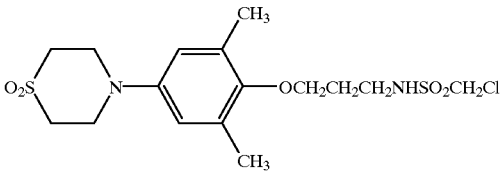
TB-136
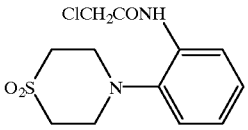
TB-137
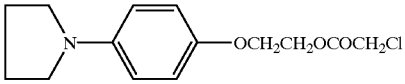
TB-138
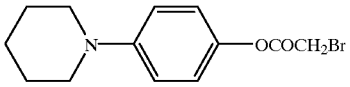
-continued
TB-139
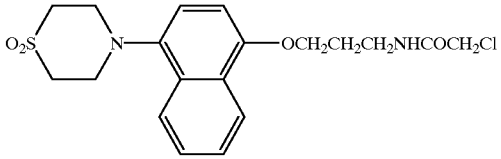
TB-140
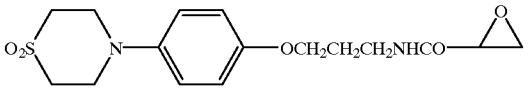
TB-201
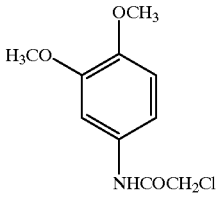
TB-202
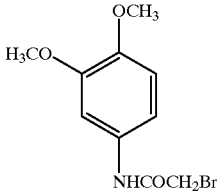
TB-203
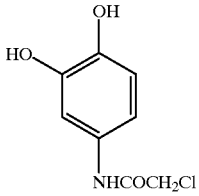
TB-204
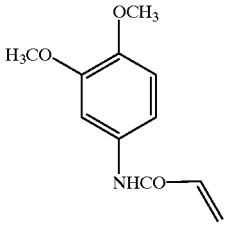
TB-205
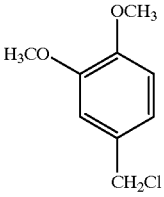

-continued
TB-206
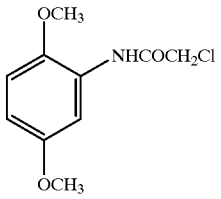
TB-207
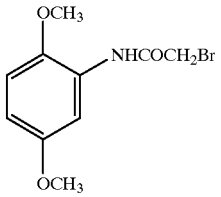
TB-208
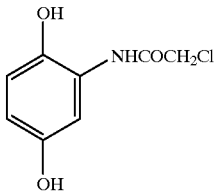
TB-209
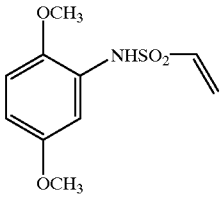
TB-210
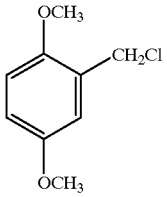
TB-211
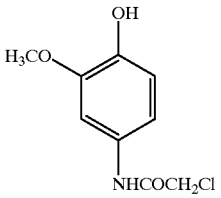
TB-212
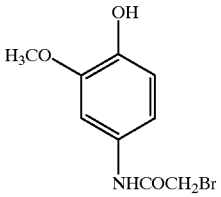
-continued
TB-213
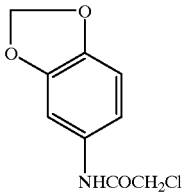
TB-214
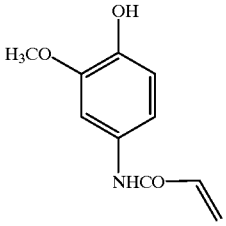
TB-215
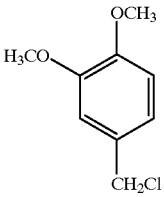
TB-216
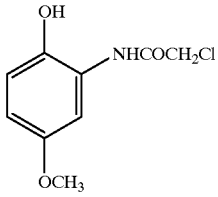
TB-217
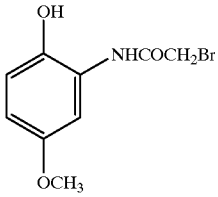
TB-218
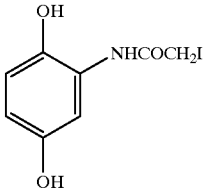
TB-219
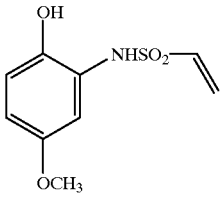

-continued
TB-220
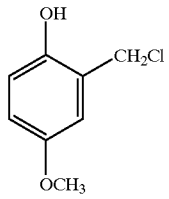
TB-221
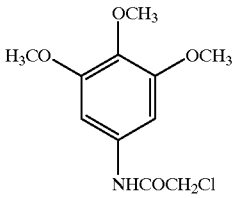
TB-222
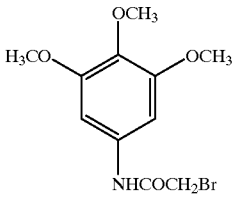
TB-223
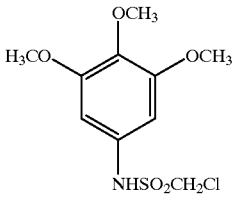
TB-224
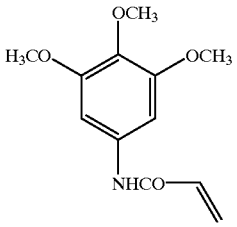
TB-225
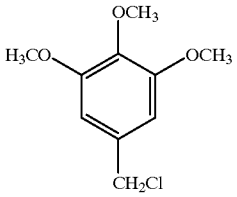
TB-226
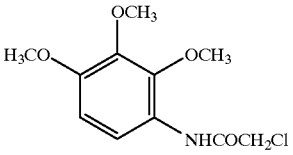
-continued
TB-227
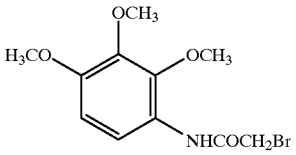
TB-228
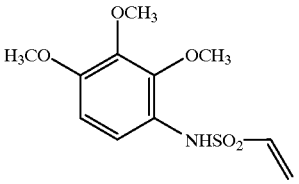
TB-229
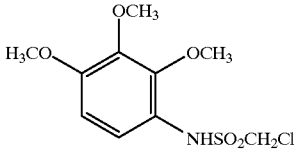
TB-230
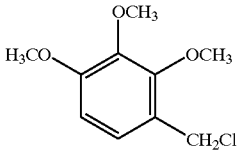
TB-231
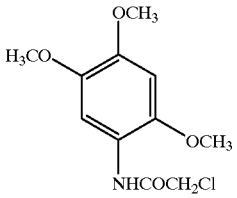
TB-232
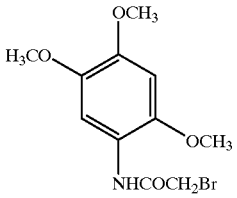
TB-233
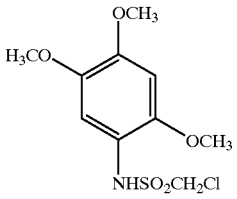
TB-234
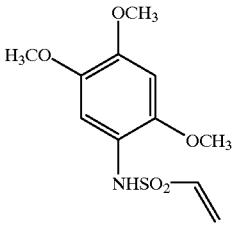

-continued
TB-235
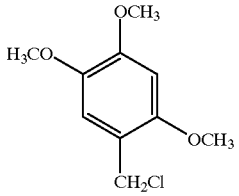
TB-236
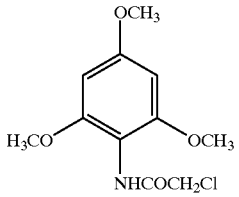
TB-237
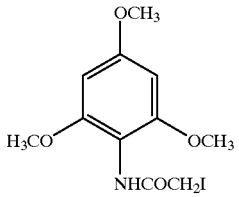
TB-238
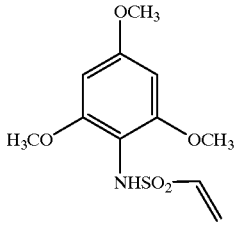
TB-239
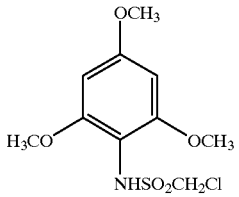
TB-240
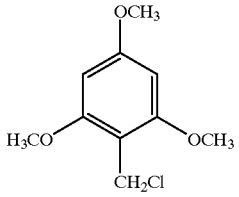
TB-241
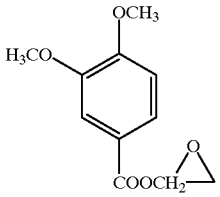
-continued
TB-242
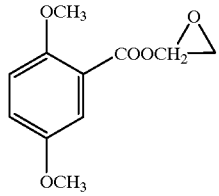
TB-243
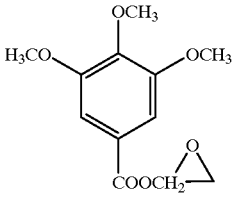
TB-244
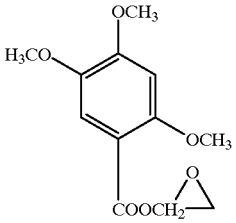
TB-245
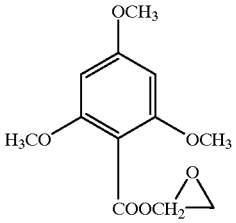
TB-246
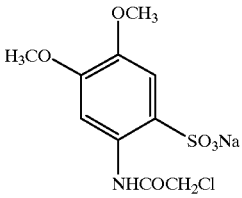
TB-247
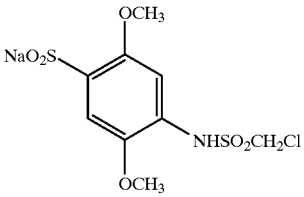
TB-248
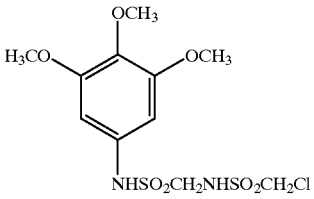

-continued
TB-249
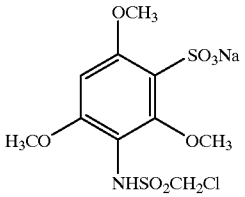
TB-250
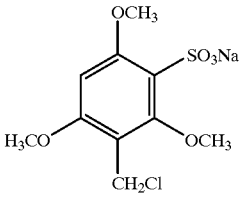
TB-251
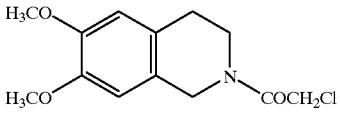
TB-252
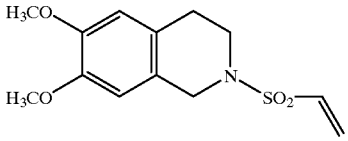
TB-253
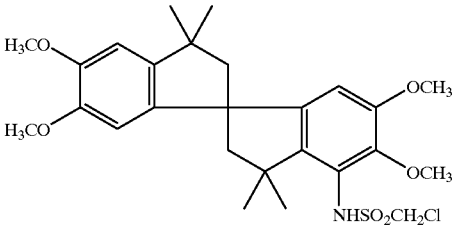
TB-254
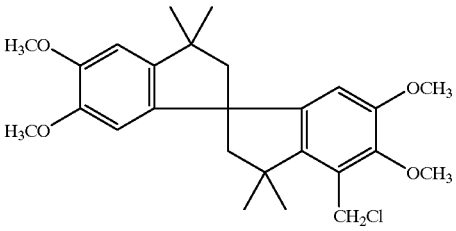
TB-255
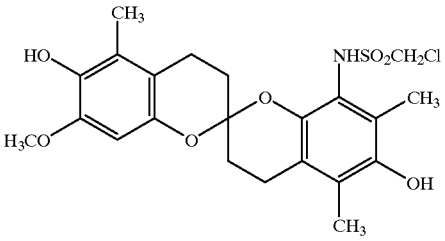
-continued
TB-256
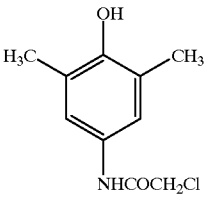
TB-257
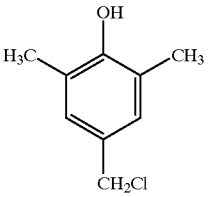
TB-258
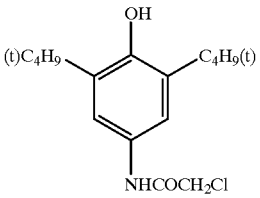
TB-259
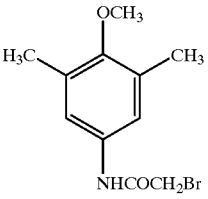
TB-260
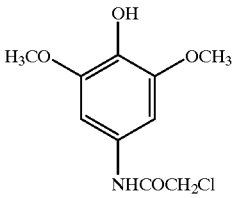
TB-261
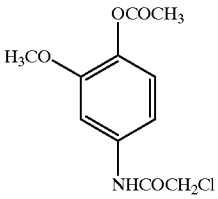
TB-262
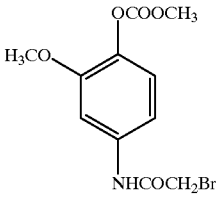

-continued
TB-263
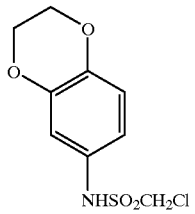
TB-264
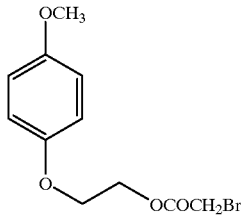
TB-265
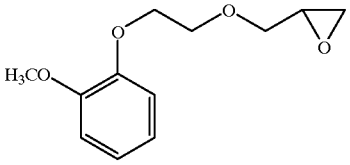
TB-266
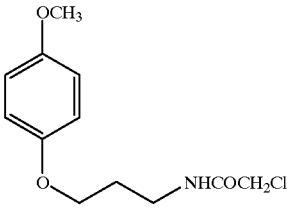
TB-267
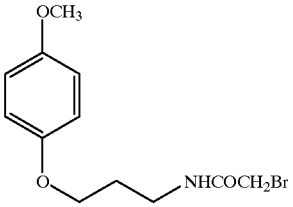
TB-268
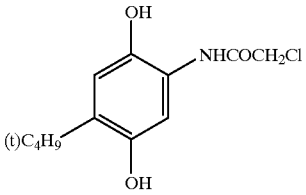
TB-269
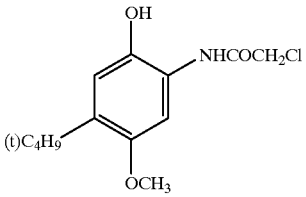
-continued
TB-270
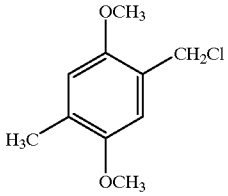
TB-271
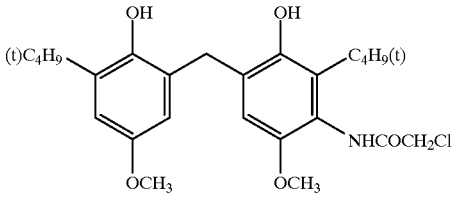
TB-272
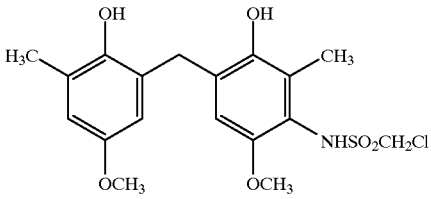
The above compounds can be synthesized by combining synthesis reactions step by step that are widely know in organic chemistry. Exemplified synthesis schemes thereof are shown below.
Synthesis of TB-6
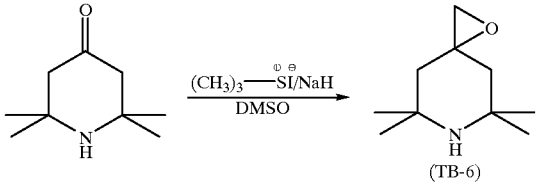
Synthesis of TB-52
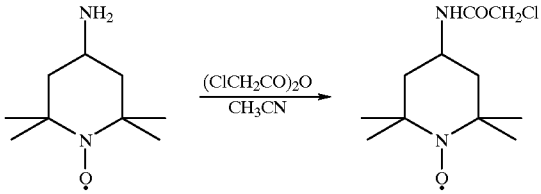
Synthesis of TB-101
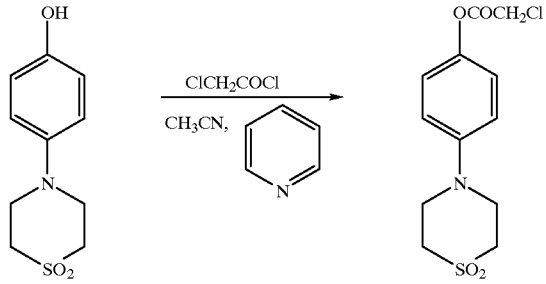

Synthesis of TB-201

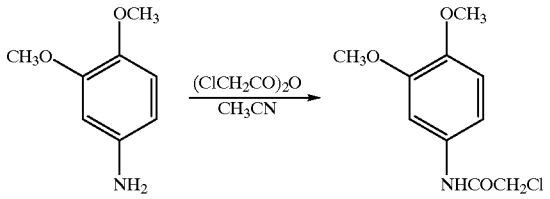

The "photographic element" of the present invention refers to all materials involved in the formation of images, and it includes a processing element, such as a processing sheet, a light-sensitive element, and a dye-fixing element.

The position where the compound represented by formula (1), (2) or (3) is to be added is described below. It is enough that the compound represented by formula (1), (2) or (3) is present together with the photographic element referred to in the present invention when an image is formed finally; and, as the position where the compound is to be added, it is enough that the compound represented by formula (1), (2) or (3) may be added anywhere so long as the compound can move to the image-fixing layer when or after the image is formed. Further, the compound may be added to one position or plural positions. Namely, the compound can be added to an arbitrary position of the photographic element or a processing solution, and specifically it can be added to any layer of a dye-fixing element, any layer of a light-sensitive element, or a processing element. Furthermore, in the case of a light-sensitive microcapsule system, the compound may be added into the capsules or the binder wherein the capsules are dispersed and fixed. The compound can also be added to a dye-fixing element after the formation of an image. Specifically, the compound represented by formula (1), (2) or (3) can be added to a dye-fixing element, for example, in such a manner that ① a solution of the compound is applied on the dye-fixing element, ② the dye-fixing element is dipped in a solution of the compound, ③ the compound contained in a processing sheet is transferred to the dye-fixing element, or ④ a solution of the compound is sprayed like an ink of an ink jet printer. Taking the fixing of the compound by the reaction with the binder into consideration, which is intended to cause in the present invention, however, preferably the compound is added to the same layer where the binder of the subject, particularly the mordant polymer, is added; and as a more preferable method, can be mentioned a method wherein the compound represented by formula (1), (2) or (3) is added to a mordant polymer solution previously, to allow the chemical reaction to take place, followed by coating the resultant solution.

The compound represented by formula (1), (2) or (3) may be added in such a manner that the compound is added after dissolving in water, or that the compound is added after dissolving in an organic solvent, such as alcohols or ketones, or a mixed solvent of such an organic solvent with water, if it is not separated when added to a coating solution. The compound represented by formula (1), (2) or (3) may also be added after dissolved in an acid or a base or included in a inclusion (clathrate) compound.

In addition to one or more of the compound(s) represented by formula (1), (2) or (3), plural anti-fading agents may be added in combination, to the photographic element of the present invention. Preferably, in the present invention, anti-fading agents are finally present in a total amount to be added of 1 mmol/$m^2$ or more, and more preferably 2 mmol/$m^2$ to 20 mmol/$m^2$, in the image-fixing element after the formation of an image. The molar amount of the compound represented by formula (1), (2) or (3) to be added is generally 0.0001 to 1,000 times, preferably 0.001 to 100 times, and more preferably 0.01 to 10 times, the reaction sites of the binder to be reacted therewith.

The compound represented by formula (1), (2) or (3) can be used in combination with other anti-fading agents, as well as in combination with other anti-fading means, such as addition of an ultraviolet absorber, and a laminate.

The compound represented by formula (1), (2) or (3) can be used in combination with a compound that releases active oxygen. As the active-oxygen-releasing agent, can be mentioned a certain kind of image-forming dye, titanium oxide, a fluorescent whitening agent, a transition metal salt, etc. An ultraviolet absorbing agent can also be used as an active-oxygen-releasing agent.

The image-fixing material used in the present invention has at least a layer for fixing a dye for forming an image on a base, and to said dye-fixing layer is added such a material as a mordant, a metal salt, and an ink absorber, in accordance with the method for fixing the dye. Further, if necessary, a surface protective layer, a timing layer, and an acid-neutralizing layer may be provided thereon, and a base-generating agent, a heat solvent, a whitening agent, an antifoggant, a stabilizer, a hardener, a plasticizer, a high-boiling organic solvent, a coating aid, a surfactant, an antistatic agent, a matting agent, a slip agent, an antioxidant, etc. may be contained therein.

Specifically, for example, a dye-fixing element described in JP-A-8-304982, a dye-image-receiving material described in JP-A-9-5968, an image-receiving material described in JP-A-9-34081, an image-receiving element described in JP-A-10-142765 (Japanese patent application No. 8-316885), and an image-receiving element (dye-fixing element) described in JP-A-9-152705 can be mentioned and more preferable embodiments are also described in them.

The light-sensitive material used in the present invention has, basically, a light-sensitive silver halide, a binder, and a dye-providing compound, on a base; and it may contain, if necessary, a chemical sensitizer, a sensitivity increaser, a spectral sensitizer, a supersensitizer, a whitening agent, an antifoggant, a stabilizer, a light absorber, a filter dye, a hardener, a base-generating agent, a plasticizer, a high-boiling organic solvent, a coating aid, a surfactant, an antistatic agent, a matting agent, and the like.

Specifically, a heat-developable color light-sensitive material described in JP-A-9-15805, a diffusion transfer silver halide light-sensitive material described in JP-A-9-152705, a color light-sensitive material described in JP-A-9-90582, a heat-developable color light-sensitive material described in JP-A-9-34081, and a color diffusion transfer light-sensitive material described in JP-A-10-142765 can be mentioned, and more preferable embodiments are also described in them.

In the present invention, an alkali processing composition can be used, if necessary. The alkali processing composition is spread uniformly between the light-sensitive element and the image-receiving element after the exposure of the light-sensitive element, to carry out development of the light-sensitive layer. The alkali processing composition contains an alkali and a developing agent, and further contains, if necessary, a thickening agent, a development accelerator, a development inhibitor, an antioxidant, or the like. Specifically, the processing composition described in JP-A-10-142765 corresponds to the alkali processing composition, and more preferable embodiments are also described therein.

In the present invention, as a base (support) of a light-sensitive material or an image-fixing material, can be mentioned photographic bases, such as papers and synthetic polymers (films), as described in "Shashin Kogaku no Kiso—Ginen Shashin-hen—," edited by Nihon Shashin-gakkai and published by Korona-sha, 1979, pages (223) to (240). Specifically, use can be made, for example, of polyethylene terephthalates (PETs), polyethylene naphthalates (PENs), polycarbonates, polyvinyl chlorides, polystyrenes, polypropylenes, polyimides, celluloses (e.g., triacetylcellulose); those obtained by incorporating a pigment, such as titanium oxide, into films made of these; synthetic papers made from polypropylenes or the like by the film method; papers made by mixing synthetic resin pulps, for example, of polyethylenes, with natural pulp; Yankee paper, baryta paper, coated papers (particularly, cast-coated papers), metals, cloths, glasses, ceramics, etc.

These may be used singly or may be used in the form of a base one or both of whose surfaces are laminated with a synthetic polymer, such as polyethylenes, PETs, polyesters, and polystyrenes.

In addition to the above, bases described, for example, in JP-A-62-253159, pages (29) to (31), JP-A-1-161236, pages (14) to (17), JP-A-63-316848, JP-A-2-22651, JP-A-3-56955, and U.S. Pat. No. 5,001,033 can be used.

The surface of these bases may be coated with a hydrophilic binder plus a semiconductive metal oxide, such as tin oxide and alumina sol, carbon black, and another antistatic agent.

Further, for the purpose of improving wettability of the coating solution and improving adhesion between the coated film and the base, gelatin and a polymer, such as PVA, are also preferably applied to the surface of these bases previously.

The thickness of the base varies depending on the purpose of the use (application), and it is generally 40 $\mu$m or more, but 400 $\mu$m or less. However, in the case of a method wherein an image is formed using elements coated on two or more separate bases, preferably the base in which the image on that element is not finally used, is a base thinner than the thickness in the above range, i.e., a base having a thickness of 5 $\mu$m or more, but 250 $\mu$m or less. As the thinner base, use can be made, for example, of a film of PET on which aluminum is vacuum-evaporated.

Particularly when heat resistance and curling properties are severely demanded, as bases for light-sensitive materials, use can be preferably made of bases, as described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129, and JP-A-7-219144.

Example methods of exposing the light-sensitive material to light and recording an image, include a method wherein a landscape, a man, or the like is directly photographed by a camera or the like; a method wherein exposure to light is carried out through a reversal film or a negative film using, for example, a printer or an enlarging apparatus; a method wherein an original picture is subjected to scanning exposure through a slit by using an exposure apparatus of a copying machine or the like; a method wherein light-emitting diodes, various lasers, or the like are allowed to emit light, to carry out exposure of image information, through electrical signals; and a method wherein image information is outputted to an image display apparatus, such as a CRT, a liquid crystal display, an electroluminescence display, and a plasma display, and exposure is carried out directly or through an optical system.

Light sources that can be used for recording an image on the light-sensitive material, as mentioned above, include natural light, and light sources and exposure methods as described in U.S. Pat. No. 4,500,626, column 56, JP-A-2-53378, and JP-A-2-54672, such as a tungsten lamp, a light-emitting diode, a laser light source, and a CRT light source.

Further, use can be made of a light source in which a green-light emitting diode and a red-light emitting diode are used in combination, with a blue-light emitting diode that is remarkably developed recently. Particularly, exposure apparatuses described in JP-A-7-140567, JP-A-7-248549, JP-A-7-248541, JP-A-7-295115, JP-A-7-290760, JP-A-7-301868, JP-A-7-301869, JP-A-7-306481, and JP-A-8-15788 can be preferably used.

Further, Image-wise exposure can be carried out by using a wavelength-converting element that uses a nonlinear optical material and a coherent light source, such as laser rays, in combination. Herein the term "nonlinear optical material" refers to a material that can develop nonlinearity between the electric field and the polarization that appears when subjected to a strong photoelectric field, such as laser rays; and as the material, use can be preferably made of inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53,462 and JP-A-62-210,432. As the form of the wavelength-converting element, for example, a single crystal optical waveguide type and a fiber type are known, both of which are useful.

Further, as the above image information, can be employed, for example, image signals obtained from video cameras, electronic still cameras, and the like; television signals, represented by Nippon Television Singo Kikaku (NTSC); image signals obtained by dividing an original picture into a number of picture elements by a scanner or the like; and image signals produced by a computer, represented by CG or CAD.

The light-sensitive material and/or the dye-fixing element of the present invention can be used in various applications. For example, the dye-fixing element after the heat-development transfer can be used as a positive or negative color printing material. Further, by using a light-sensitive material wherein a black dye-providing substance or a mixture of yellow-, magenta-, and cyan-dye-providing substances is used, it can be used as a black and white positive or negative printing material, a material for printing, such as a light-sensitive material for lithography, or a material for radiography. Particularly, if it is used as a material for obtaining a print from a shooting (photographing) material, preferably a shooting material having an information recording function, as disclosed in JP-A-6-163450 and JP-A-4-338944, is used to expose the light-sensitive material of the present invention, to form a print on the dye-fixing element of the present invention by heat-development transfer. As this printing method, methods described in JP-A-5-241251, JP-A-5-19364, and JP-A-5-19363 can be used.

Further, by desilvering suitably the light-sensitive material after the heat-development transfer, it can be used as a shooting material. In that case, as the base, for example, a base having a magnetic substance layer, as described in JP-A-4-124645, JP-A-5-40321, JP-A-6-35092, or JP-A-6-317875, is preferably used to record shooting information or the like.

The light-sensitive material and/or the dye-fixing element of the present invention may be in the form that has an electroconductive heat-generating material layer as a heating means for heat development and diffusion transfer of the dye. In this case, as the heat-generating element, one described, for example, in JP-A-61-145544 can be employed.

The heating temperature in the heat development process is generally about 50 to 250° C., and particularly a heating temperature of about 60 to 180° C. is useful. The diffusion transfer process of the dye may be carried out simultaneously with the heat development or after the completion of the heat development process. In the latter case, the heating temperature in the transfer process may be in the range from the temperature in the heat development process to the room temperature, and it is preferably particularly 50° C. or more, but upto a temperature about 10° C. lower than the temperature of the heat development process.

Although the transfer of the dye can be brought about only by heat, a solvent may be used to accelerate the dye transfer. Further, it is also useful to use a method described, for example, in U.S. Pat. Nos. 4,704,345, 4,740,445, and JP-A-61-238056 wherein the development and the transfer are carried out at the same time or successively by heating in the presence of a small amount of a solvent (particularly water). In this system, the heating temperature is preferably 50° C. or more, but upto the boiling point of the solvent, and for example, in the case wherein the solvent is water, the heating temperature is preferably 50° C. to 100° C.

Examples of the solvent that is used for acceleration of development and/or for diffusion transfer of dyes, include water, an aqueous basic solution containing an inorganic alkali metal salt or an organic base (as the base, those described in the section of image formation-accelerating agents can be used), a low-boiling solvent, and a mixed solution of a low-boiling solvent with water or the above-mentioned aqueous basic solution. Also, a surface-active agent, an antifoggant, a complex-forming compound with a hardly-soluble metal salt, a mildew-proofing agent, and an antifungus agent may be contained in the solvent.

As the solvent to be used in these heat development and diffusion transfer steps, water is preferably used, and the water may be any water that is generally used. Specifically, for example, distilled water, tap water, well water, and mineral water can be used. In the heat-development apparatus in which the light-sensitive material and the dye-receiving element of the present invention are used, water may be used only once, or it may be circulated for repeated use. In the latter case, water that contains components dissolved out of the material will be used. Also, apparatuses and water described, for example, in JP-A-63-144354, JP-A-63-144355, JP-A-62-38460, and JP-A-3-210555 may be used.

These solvents may be used in such a way that they are applied to the light-sensitive material or the dye-fixing element, or to both of them. The amount of the solvent to be used may be the weight of the solvent corresponding to or below the maximum swell volume of the entire coated film.

As the method of applying water, for example, methods described in JP-A-62-253159, page (5), and JP-A-63-85544 are preferably used. Further, the solvent may be enclosed in microcapsules or may take the form of a hydrate, to be previously built into either or both of the light-sensitive material and dye-fixing element, for use.

The suitable temperature of the water to be applied is generally 30 to 60° C., as described, for example, in JP-A-63-85544, supra.

To accelerate the dye transfer, a system can be adopted wherein a hydrophilic heat solvent that is solid at normal temperatures and melts at a higher temperature is built in the light-sensitive material and/or the dye-fixing element. The layer wherein the hydrophilic heat solvent is built in may be any of the light-sensitive silver halide emulsion layer, the intermediate layer, the protective layer, and the dye-fixing layer, but preferably it is the dye-fixing layer and/or the layer adjacent thereto.

Examples of the hydrophilic heat solvent include ureas, pyridines, amides, sulfonamides, imides, alcohols, oximes, and other heterocyclic compounds.

Example heating methods in the development step and/or transfer step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere.

As a method wherein the light-sensitive material and a dye-fixing element are placed one upon the other, methods described in JP-A-62-253159 and JP-A-61-147244, on page (27), can be applied.

To process the photographic element of the present invention, any of various development apparatuses can be used, as required. For example, apparatuses described, for example, in JP-A-59-75247, JP-A-59-177547, JP-A-59-181353, and JP-A-60-18951, JU-A-62-25944 ("JU-A" means unexamined published Japanese utility model application), JP-A-6-130509, JP-A-6-95338, JP-A-6-95267, JP-A-8-29955, and JP-A-8-29954 can be preferably used. As a commercially available apparatus, for example, PICTROSTAT 100, PICTROSTAT 200, PICTROSTAT 300, PICTROSTAT 330, PICTROGRAPHY 3000, and PICTROGRAPHY 4000 (all trade names, manufactured by Fuji Photo Film Co., Ltd.), can be used.

According to the present invention, by using the compound represented by formula (1), (2), or (3), a color image excellent in light-fastness can be obtained.

In particular, according to the present invention, by using the compound represented by formula (1), a color image excellent in light-fastness with a quite high color-density (Dmax) retained, can be obtained.

Next, the present invention is described in more detail based on the following examples, but the invention is not limited to those.

EXAMPLES

Example 1

Dye-fixing element (Image-receiving sheet) R-1, having the base and layer constitution, as respectively shown in Tables 1 and 2, was prepared.

TABLE 1

Constitution of Base

| Name of layer | Composition | Film thickness (μm) |
|---|---|---|
| Surface undercoat layer | Gelatin | 0.1 |

TABLE 1-continued

Constitution of Base

| Name of layer | Composition | Film thickness (μm) |
|---|---|---|
| Surface PE layer (Glossy) | Low-density polyethylene (Density 0.923): 90.2 parts<br>Surface-processed titanium oxide: 9.8 parts<br>Ultramarine: 0.001 parts | 36.0 |
| Pulp layer | Fine quality paper (LBKP/NBKP = 6/4, Density 1.053) | 152.0 |
| Back-surface PE layer (Matte) | High-density polyethylene (Density 0.955) | 27.0 |
| Back-surface undercoat layer | Styrene/acrylate copolymer<br>Colloidal silica<br>Poly(sodium styrenesulfonate) | 0.1 |
| | | 215.2 |

TABLE 2

Constitution of Image-Receiving Element R-1

| Number of layer | Additive | Coating amount ($mg/m^2$) |
|---|---|---|
| Sixth layer | Water-soluble polymer(1) | 130 |
| | Water-soluble polymer(2) | 35 |
| | Water-soluble polymer(3) | 45 |
| | Potassium nitrate | 20 |
| | Anionic surfactant(1) | 6 |
| | Anionic surfactant(2) | 6 |
| | Amphoteric surfactant(1) | 50 |
| | Anti-stain agent(1) | 7 |
| | Anti-stain agent(2) | 12 |
| | Matting agent(1) | 7 |
| Fifth layer | Gelatin | 250 |
| | Water-soluble polymer(1) | 25 |
| | Anionic surfactant(3) | 9 |
| | Hardener(1) | 185 |
| Fourth layer | Mordant (1) | 1850 |
| | Water-soluble polymer(2) | 260 |
| | Water-soluble polymer(4) | 1400 |
| | Dispersion of latex(1) | 600 |
| | Anionic surfactant(3) | 25 |
| | Nonionic surfactant(1) | 18 |
| | Guanidine picolinate | 2550 |
| | Sodium quinolinate | 350 |
| Third layer | Gelatin | 370 |
| | Mordant (1) | 300 |
| | Anionic surfactant(3) | 12 |
| Second layer | Gelatin | 700 |
| | Mordant (1) | 290 |
| | Water-soluble polymer(1) | 55 |
| | Water-soluble polymer(2) | 330 |
| | Anionic surfactant(3) | 30 |
| | Anionic surfactant(4) | 7 |
| | High-boiling organic solvent(1) | 700 |
| | Brightening agent(1) | 30 |
| | Anti-stain agent(3) | 32 |
| | Guanidine picolinate | 360 |
| | Sodium quinolinate | 45 |
| First layer | Gelatin | 280 |
| | Water-soluble polymer(1) | 12 |
| | Anionic surfactant(1) | 14 |
| | Sodium metaborate | 35 |
| | Hardener(1) | 185 |
| Base | Paper Base of Table 1 (thickness 215 μm) | |

The coating amount of Dispersion of latex is in terms of a coating amount of the latex solid content.

Anionic surfactant (1)

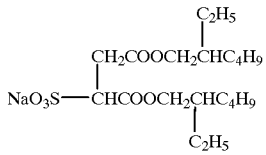

Anionic surfactant (2)

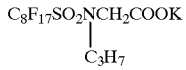

Anionic surfactant (3)

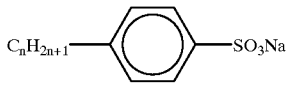

n ≒ 12.6

Anionic surfactant (4)

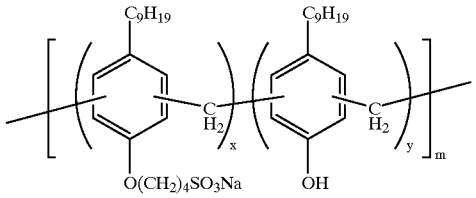

x:y = 4:6
m ≒ 6.8

Nonionic surfactant (1)

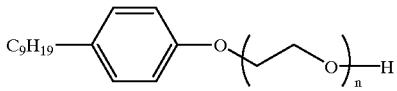

n = 85

Amphoteric surfactant (1)

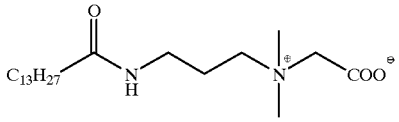

Brightening agent (1)

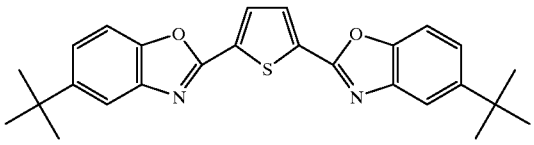

Mordant (1)

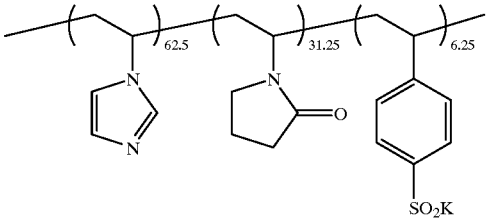

Anti-stain agent (1)

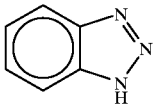

-continued

Anti-stain agent (2)

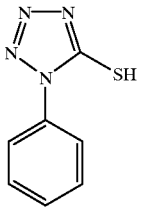

Anti-stain agent (3)

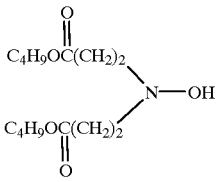

High-boiling organic solvent(1)

$C_{28}H_{46.9}Cl_{7.1}$ EMPARA 40 (trade name: manufactured by Ajinomoto K.K.)

Water-soluble polymer(1)

Sumikagel L5-H (trade name: manufactured by Sumitomo Kagaku CO.)

Water-soluble polymer(2)

Dextran (molecular weight 70,000)

Water-soluble polymer(3)

κ (kappa)-Carrageenan (trade name: manufactured by Taito Co.)

Water-soluble polymer(4)

MP polymer MP-102 (trade name: manufactured by Kuraray Co.)

Dispersion of latex(1)

LX-438 (trade name: manufactured by Nippon Zeon Co.)

Matting agent (1)

SYLOID79 (trade name: manufactured by Fuji Davisson Kagaku Co.)

Hardener(1)

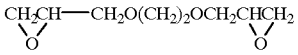

Next, Image-receiving sheets R-2 to R-15 having the same composition as that of R-1 were prepared, except that a compound for compararison or the compound for use in the present invention was added to the second layer, as shown in Table 3, respectively. Each of the thus-prepared Image-receiving sheets R-1 to R-15 was set in an image-receiving sheet magazine of a PICTROSTAT 330, trade name, manufactured by Fuji Photo Film Co., Ltd. First, the positive donor was exposed for 0.1 sec at 2,500 lux through a stepwise ND filter, wherein the gray density was changed each by 0.3 step by step. Further, the negative donor was similarly exposed for 0.1 sec at 2,500 lux through a stepwise ND filter. Then the thus-exposed light-sensitive material was set in a light-sensitive material magazine of the PICTROSTAT 330 and it was subjected to heat-development under standard processing conditions, and a gray image corresponding to the filter used for the exposure was obtained sharply on the image-receiving sheet. The reflection densities of the Dmax parts of the exposed parts of the samples were measured with an X-rite densitometer. The results are shown in Tables 4 and 5. After the samples were subjected to a 10-day exposure test using a xenon fade-o-meter of 300,000 lux, the residual rate of the cyan dye at the point having an initial cyan density of 1.0±0.1 at the gray part was measured. The results are shown in Tables 6 and 7.

TABLE 3

| Image-receiving sheet No. | Kind of anti-fading agent | Added amount (mmol/m$^2$) |
|---|---|---|
| R-1 (Comparative example) | none | |
| R-2 (Comparative example) | A1 | 5 |
| R-3 (Comparative example) | A1 | 10 |
| R-4 (Comparative example) | B1 | 5 |
| R-5 (Comparative example) | B1 | 10 |
| R-6 (Comparative example) | C1 | 1 |
| R-7 (Comparative example) | D1 | 1 |
| R-8 (This invention) | TB-12 | 5 |
| R-9 (This invention) | TB-15 | 5 |
| R-10 (This invention) | TB-45 | 1 |
| R-11 (This invention) | TB-46 | 1 |
| R-12 (This invention) | TB-52 | 1 |
| R-13 (This invention) | TB-53 | 1 |
| R-14 (This invention) | TB-55 | 1 |
| R-15 (This invention) | TB-57 | 1 |

A1

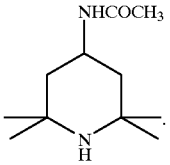

B1

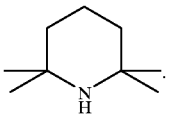

C1

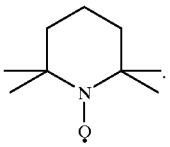

D1

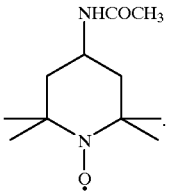

TABLE 4

(Positive light-sensitive material)

| Image-receiving sheet No. | Dmax(R) | Dmax(G) | Dmax(B) |
|---|---|---|---|
| R-1 (Comparative example) | 2.13 | 2.28 | 2.07 |
| R-2 (Comparative example) | 1.97 | 2.03 | 1.81 |
| R-3 (Comparative example) | 1.75 | 1.86 | 1.68 |
| R-4 (Comparative example) | 1.96 | 2.01 | 1.82 |
| R-5 (Comparative example) | 1.77 | 1.89 | 1.71 |
| R-6 (Comparative example) | 1.92 | 2.01 | 1.85 |
| R-7 (Comparative example) | 1.95 | 1.99 | 1.81 |
| R-8 (This invention) | 2.11 | 2.24 | 2.04 |
| R-9 (This invention) | 2.13 | 2.23 | 2.05 |
| R-10 (This invention) | 2.17 | 2.29 | 2.07 |

TABLE 4-continued (Positive light-sensitive material)

| Image-receiving sheet No. | Dmax(R) | Dmax(G) | Dmax(B) |
|---|---|---|---|
| R-11 (This invention) | 2.15 | 2.31 | 2.06 |
| R-12 (This invention) | 2.16 | 2.29 | 2.08 |
| R-13 (This invention) | 2.17 | 2.28 | 2.09 |
| R-14 (This invention) | 2.13 | 2.27 | 2.08 |
| R-15 (This invention) | 2.14 | 2.26 | 2.08 |

TABLE 5

(Negative light-sensitive material)

| Image-receiving sheet No. | Dmax(R) | Dmax(G) | Dmax(B) |
|---|---|---|---|
| R-1 (Comparative example) | 2.27 | 2.35 | 2.17 |
| R-2 (Comparative example) | 2.01 | 2.11 | 1.89 |
| R-3 (Comparative example) | 1.87 | 1.96 | 1.64 |
| R-4 (Comparative example) | 2.01 | 2.07 | 1.91 |
| R-5 (Comparative example) | 1.91 | 1.97 | 1.63 |
| R-6 (Comparative example) | 2.01 | 2.11 | 1.85 |
| R-7 (Comparative example) | 2.03 | 2.14 | 1.86 |
| R-8 (This invention) | 2.29 | 2.36 | 2.19 |
| R-9 (This invention) | 2.27 | 2.35 | 2.17 |
| R-10 (This invention) | 2.31 | 2.34 | 2.18 |
| R-11 (This invention) | 2.28 | 2.33 | 2.16 |
| R-12 (This invention) | 2.27 | 2.36 | 2.18 |
| R-13 (This invention) | 2.29 | 2.38 | 2.17 |
| R-14 (This invention) | 2.31 | 2.37 | 2.18 |
| R-15 (This invention) | 2.29 | 2.37 | 2.19 |

TABLE 6

(Residual rate of dye in the positive light-sensitive material)

| Image-receiving sheet No. | Residual rate of dye (%) |
|---|---|
| R-1 (Comparative example) | 65 |
| R-2 (Comparative example) | 80 |
| R-3 (Comparative example) | 85 |
| R-4 (Comparative example) | 80 |
| R-5 (Comparative example) | 85 |
| R-6 (Comparative example) | 83 |
| R-7 (Comparative example) | 82 |
| R-8 (This invention) | 81 |
| R-9 (This invention) | 82 |
| R-10 (This invention) | 86 |
| R-11 (This invention) | 84 |
| R-12 (This invention) | 83 |
| R-13 (This invention) | 83 |
| R-14 (This invention) | 83 |
| R-15 (This invention) | 84 |

TABLE 7

(Residual rate of dye in the negative light-sensitive material)

| Image-receiving sheet No. | Residual rate of dye (%) |
|---|---|
| R-1 (Comparative example) | 67 |
| R-2 (Comparative example) | 82 |
| R-3 (Comparative example) | 85 |
| R-4 (Comparative example) | 81 |
| R-5 (Comparative example) | 87 |
| R-6 (Comparative example) | 86 |
| R-7 (Comparative example) | 85 |
| R-8 (This invention) | 83 |

TABLE 7-continued (Residual rate of dye in the negative light-sensitive material)

| Image-receiving sheet No. | Residual rate of dye (%) |
|---|---|
| R-9 (This invention) | 85 |
| R-10 (This invention) | 88 |
| R-11 (This invention) | 86 |
| R-12 (This invention) | 87 |
| R-13 (This invention) | 88 |
| R-14 (This invention) | 87 |
| R-15 (This invention) | 88 |

As is apparent from the results shown in Tables 4 to 7, it is recognized that, in Comparative Samples R-2 to R-7 wherein a simple piperidine compound derivative or a TEMPO derivative was used, the Dmax density of the image was conspicuously lowered in comparison with R-1. In contrast, in R-8 to R-15 according to the present invention wherein the compound for use in the present invention was used, any decrease in Dmax was not observed. Further, with respect to the effect of prevention of fading, it is understood that, in the samples according to the present invention, the effect of prevention of fading was equal to or higher than that of the samples of the Comparative Examples. Thus, the effects of the present invention, prevention of fading and quite high Dmax, are apparent.

Example 2

Image-receiving sheets R-101 to R-104 having the same composition as that of R-1 in the above Example 1 were prepared, except that a compound for comparison or the compound for use in the present invention was added to the second layer, as shown in Table 8, respectively. Each of the thus-prepared Image-receiving sheets R-1, and R-101 to R-104 was subjected to exposure to light and heat-development in the same manner as in the above Example 1, and a gray image corresponding to the filter used for the exposure was obtained sharply on the image-receiving sheet. After the samples were subjected to a 10-day exposure test using a xenon fade-o-meter of 300,000 lux, the residual rate of each dye at the point having an initial cyan density of 1.0±0.1 at the gray part was measured. The results are shown in Tables 9 and 10.

TABLE 8

| Image-receiving sheet No. | Kind of anti-fading agent | Added amount (mmol/m$^2$) |
|---|---|---|
| R-1 (Comparative example) | none | |
| R-101 (Comparative example) | A2 | 1 |
| R-102 (Comparative example) | A2 | 2 |
| R-103 (Comparative example) | B2 | 1 |
| R-104 (Comparative example) | B2 | 2 |
| R-105 (Comparative example) | C2 | 1 |
| R-106 (Comparative example) | D2 | 1 |
| R-107 (This invention) | TB-101 | 1 |
| R-108 (This invention) | TB-104 | 1 |
| R-109 (This invention) | TB-107 | 1 |
| R-110 (This invention) | TB-109 | 1 |
| R-111 (This invention) | TB-112 | 1 |
| R-112 (This invention) | TB-119 | 1 |
| R-113 (This invention) | TB-124 | 1 |
| R-114 (This invention) | TB-126 | 1 |

A2

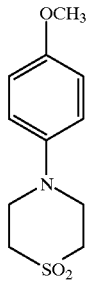

B2

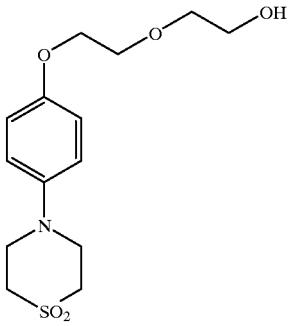

C2

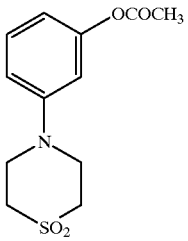

D2

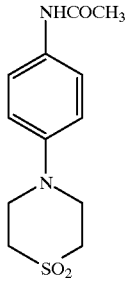

TABLE 9

(Results of fading test in the positive light-sensitive material)

| Image-receiving sheet No. | Residual rate of dye (R, %) | Residual rate of dye (G, %) | Residual rate of dye (B, %) |
|---|---|---|---|
| R-1 (Comparative example) | 62 | 71 | 80 |
| R-101 (Comparative example) | 64 | 75 | 86 |
| R-102 (Comparative example) | 67 | 77 | 89 |
| R-103 (Comparative example) | 63 | 75 | 86 |
| R-104 (Comparative example) | 67 | 78 | 89 |
| R-105 (Comparative example) | 66 | 74 | 87 |
| R-106 (Comparative example) | 64 | 74 | 85 |
| R-107 (This invention) | 75 | 88 | 95 |
| R-108 (This invention) | 76 | 89 | 97 |
| R-109 (This invention) | 77 | 87 | 98 |

TABLE 9-continued (Results of fading test in the positive light-sensitive material)

| Image-receiving sheet No. | Residual rate of dye (R, %) | Residual rate of dye (G, %) | Residual rate of dye (B, %) |
|---|---|---|---|
| R-110 (This invention) | 76 | 88 | 97 |
| R-111 (This invention) | 77 | 89 | 98 |
| R-112 (This invention) | 78 | 87 | 96 |
| R-113 (This invention) | 76 | 88 | 97 |
| R-114 (This invention) | 76 | 87 | 98 |

TABLE 10

(Results of fading test in the negative light-sensitive material)

| Image-receiving sheet No. | Residual rate of dye (R, %) | Residual rate of dye (G, %) | Residual rate of dye (B, %) |
|---|---|---|---|
| R-1 (Comparative example) | 55 | 63 | 76 |
| R-101 (Comparative example) | 63 | 75 | 81 |
| R-102 (Comparative example) | 67 | 77 | 83 |
| R-103 (Comparative example) | 61 | 74 | 81 |
| R-104 (Comparative example) | 66 | 76 | 85 |
| R-105 (Comparative example) | 64 | 74 | 82 |
| R-106 (Comparative example) | 63 | 74 | 82 |
| R-107 (This invention) | 78 | 88 | 96 |
| R-108 (This invention) | 76 | 88 | 95 |
| R-109 (This invention) | 75 | 86 | 96 |
| R-110 (This invention) | 74 | 87 | 97 |
| R-111 (This invention) | 76 | 88 | 96 |
| R-112 (This invention) | 75 | 87 | 97 |
| R-113 (This invention) | 76 | 88 | 96 |
| R-114 (This invention) | 74 | 89 | 95 |

As is apparent from the results shown in Tables 9 and 10, by comparing the samples R-101 to R-106 of the Comparative Examples that contained the compound for comparison having no group that would react with the binder, with the samples R-107 to R-114 (This invention) that utilized the compound for use in the present invention, it can be understood that the samples according to the present invention could exhibited the marked effects on prevention of fading. These effects were recognized both in the system wherein negative light-sensitive materials were used and in the system wherein positive light-sensitive materials were used. Thus, the effects of the present invention, prevention of fading, are apparent.

Example 3

Image-receiving sheets R-201 to R-214 having the same composition as that of R-1 in the above Example 1 were prepared, except that a compound for comparison or the compound for use in the present invention was added to the second layer, as shown in Table 11, respectively. Each of the thus-prepared Image-receiving sheets R-1, and R-201 to R-214 was subjected to exposure to light and heat-development in the same manner as in the above Example 1, and a gray image corresponding to the filter used for the exposure was obtained sharply on the image-receiving sheet. After the samples were subjected to a 10-day exposure test using a xenon fade-o-meter of 300,000 lux, the residual rate of each dye at the point having an initial cyan density of 1.0±0.1 at the gray part was measured. The results are shown in Tables 12 and 13.

TABLE 11

| Image-receiving sheet No. | Kind of anti-fading agent | Added amount (mmol/m$^2$) |
|---|---|---|
| R-1 (Comparative example) | none | |
| R-201 (Comparative example) | A3 | 1 |
| R-202 (Comparative example) | A3 | 2 |
| R-203 (Comparative example) | B3 | 1 |
| R-204 (Comparative example) | B3 | 2 |
| R-205 (Comparative example) | C3 | 1 |
| R-206 (Comparative example) | D3 | 1 |
| R-207 (This invention) | TB-201 | 1 |
| R-208 (This invention) | TB-205 | 1 |
| R-209 (This invention) | TB-206 | 1 |
| R-210 (This invention) | TB-216 | 1 |
| R-211 (This invention) | TB-221 | 1 |
| R-212 (This invention) | TB-223 | 1 |
| R-213 (This invention) | TB-253 | 1 |
| R-214 (This invention) | TB-260 | 1 |

A3

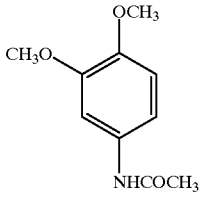

B3

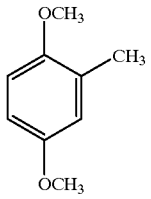

C3

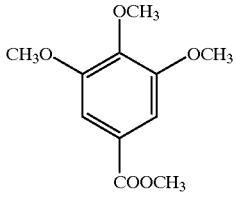

D3

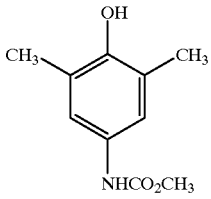

TABLE 12

(Results of fading test in the positive light-sensitive material)

| Image-receiving sheet No. | Residual rate of dye (R, %) | Residual rate of dye (G, %) | Residual rate of dye (B, %) |
|---|---|---|---|
| R-1 (Comparative example) | 61 | 70 | 81 |
| R-201 (Comparative example) | 65 | 72 | 83 |
| R-202 (Comparative example) | 67 | 75 | 85 |

TABLE 12-continued (Results of fading test in the positive light-sensitive material)

| Image-receiving sheet No. | Residual rate of dye (R, %) | Residual rate of dye (G, %) | Residual rate of dye (B, %) |
|---|---|---|---|
| R-203 (Comparative example) | 64 | 72 | 84 |
| R-204 (Comparative example) | 66 | 75 | 86 |
| R-205 (Comparative example) | 65 | 72 | 85 |
| R-206 (Comparative example) | 64 | 72 | 84 |
| R-207 (This invention) | 74 | 87 | 93 |
| R-208 (This invention) | 75 | 88 | 94 |
| R-209 (This invention) | 75 | 86 | 95 |
| R-210 (This invention) | 74 | 87 | 94 |
| R-211 (This invention) | 75 | 86 | 94 |
| R-212 (This invention) | 74 | 87 | 93 |
| R-213 (This invention) | 73 | 88 | 94 |
| R-214 (This invention) | 75 | 88 | 94 |

TABLE 13

(Results of fading test in the negative light-sensitive material)

| Image-receiving sheet No. | Residual rate of dye (R, %) | Residual rate of dye (G, %) | Residual rate of dye (B, %) |
|---|---|---|---|
| R-1 (Comparative example) | 58 | 68 | 79 |
| R-201 (Comparative example) | 62 | 73 | 81 |
| R-202 (Comparative example) | 65 | 75 | 83 |
| R-203 (Comparative example) | 64 | 75 | 81 |
| R-204 (Comparative example) | 67 | 77 | 84 |
| R-205 (Comparative example) | 65 | 76 | 83 |
| R-206 (Comparative example) | 64 | 76 | 81 |
| R-207 (This invention) | 77 | 88 | 95 |
| R-208 (This invention) | 76 | 87 | 94 |
| R-209 (This invention) | 77 | 85 | 94 |
| R-210 (This invention) | 76 | 86 | 95 |
| R-211 (This invention) | 75 | 87 | 94 |
| R-212 (This invention) | 76 | 86 | 95 |
| R-213 (This invention) | 76 | 88 | 94 |
| R-214 (This invention) | 74 | 87 | 95 |

As is apparent from the results shown in Tables 12 and 13, by comparing the samples R-201 to R-206 of the Comparative Examples wherein a simple hydroxybenzene or alkoxybenzene derivative was used, with the samples R-207 to R-214 (This invention) wherein the compound for use in the present invention was used, it is understood that the samples according to the present invention could exhibited the marked effects on prevention of fading. These effects are observed both in the system wherein negative light-sensitive materials were used and in the system wherein positive light-sensitive materials were used. Thus, the effects of the present invention, prevention of fading, are apparent.

Having described our invention as related to the present embodiments, it is our intention that the invention not be limited by any of the details of the description, unless otherwise specified, but rather be construed broadly within its spirit and scope as set out in the accompanying claims.

What we claim is:

1. A photographic element, which contains, at least in a binder on a base, at least one compound having a group that is capable of causing chemical reaction with a reactive group contained in the binder, to form a covalent bond, wherein the compound is a compound represented by the following formula (1), (2), or (3): formula (1)

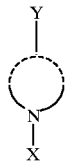

wherein the ring structure containing the N represents a nitrogen-containing nonaromatic ring having at least three ring members, X represents a hydrogen atom, an alkoxy group, an aryloxy group, an oxy radical group, a hydroxyl group, or a group capable of forming an imino group or a hydroxyimino group by hydrolysis, and Y represents a group that is capable of causing chemical reaction with a reactive group contained in the binder, to form a covalent bond;

formula (2)

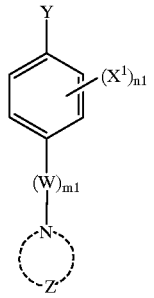

wherein $X^1$ represents a hydrogen atom or a substituent, which substituent may bond to form a ring, n1 is an integer of 1 to 4, Y represents a group that is capable of causing chemical reaction with a reactive group contained in the binder, to form a covalent bond, W represents a divalent linking group, m1 is 0 or 1, and Z represents a group of nonmetallic atoms capable of forming a 5- to 7-membered nitrogen-containing heterocyclic group; formula (3)

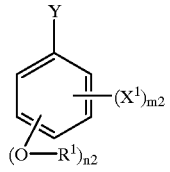

wherein $R^1$ represents a hydrogen atom, an alkyl group, an aryl group, or a group capable of forming a hydroxyl group by hydrolysis, n2 is an integer of 1 or more, $X^1$ represents a hydrogen atom or a substituent, m2 is an integer of 1 or more, with m2+n2 being 5, and Y represents a group that is capable of causing chemical reaction with a reactive group contained in the binder, to form a covalent bond.

2. The photographic element as claimed in claim 1, wherein the binder contains at least one mordant polymer.

3. The photographic element as claimed in claim 2, wherein the reactive group capable of causing reaction with the group Y in formula (1), (2), or (3) is contained in the mordant polymer.

4. The photographic element as claimed in claim 2, wherein the mordant polymer contains tertiary nitrogen atoms.

5. The photographic element as claimed in claim 1, wherein, in formula (1), the ring structure containing the N is a pyrrolidine ring or a piperidine ring.

6. The photographic element as claimed in claim 1, wherein, in formula (1), the ring structure containing the N is a tetramethylpyrrolidine or tetramethylpiperidine ring, in which a methyl group is substituted on the carbon atom adjacent to the N atom.

7. The photographic element as claimed in claim 1, wherein, in formula (1), X is the group that is capable of forming an imino group or a hydroxyimino group by hydrolysis, the group being selected from —Q—R, —Q—O—R, —Q—N—R(R'), —O—Q—R, —O—Q—O—R, or —O—Q—N—R(R'), in which Q represents a divalent linking group selected from among a carbonyl group, an imino group, an α-diketo group, a sulfonyl group, and a group —PO(R")—; R represents an alkyl group, an aryl group, or a heterocyclic group; when Q represents an imino group, R and Q may bond together to form a ring; and R' represents a hydrogen atom, an alkyl group, an aryl group, or a heterocyclic group.

8. The photographic element as claimed in claim 1, wherein, in formula (2) or (3), $X^1$ represents an alkyl group, an aryl group, a sulfo group, an alkylcarbonamido group, or an alkylsulfonamido group.

9. The photographic element as claimed in claim 1, wherein, in formula (2), m1 is 0.

10. The photographic element as claimed in claim 1, wherein, in formula (2), Z represents a group of nonmetallic atoms capable of forming, together with the N, a nitrogen/sulfur-containing 6-membered heterocycle having an S atom in the forth position counted from an N atom.

11. The photographic element as claimed in claim 1, wherein, in formula (3), $R^1$ represents a hydrogen atom or a lower alkyl group.

12. The photographic element as claimed in claim 1, wherein, in formula (1), (2), or (3), Y represents a halogenated alkyl group, a halogenomethylenearyl group, a halogenomethylenecarbonyl group, a halogenomethylenecarbonyloxy group, a halogenomethylenecarbonamido group, a halogenomethylenesulfonyl group, a halogenomethylenesulfonamido group, an alkylsulfonyloxyalkyl group, an alkylsulfonyloxymethylenearyl group, an alkylsulfonyloxymethylenecarbonyl group, an alkylsulfonyloxymethylenecarbonyloxy group, an alkylsulfonyloxymethylenecarbonamido group, an arylsulfonyloxyalkyl group, an arylsulfonyloxymethylenearyl group, an arylsulfonyloxymethylenecarbonyl group, an arylsulfonyloxymethylenecarbonyloxy group, an arylsulfonyloxymethylenecarbonamido group, a vinylcarbonyl group, a vinylcarbonyloxy group, a vinylcarbonamido group, a vinylsulfonyl group, a vinylsulfonamido group, an epoxy group, an episulfido group, or a formyl group.

13. The photographic element as claimed in claim 1, wherein the at least one compound is the compound of formula (1).

14. The photographic element as claimed in claim 1, wherein the at least one compound is the compound of formula (2).

15. The photographic element as claimed in claim 1, wherein the at least one compound is the compound of formula (3).

* * * * *